US007592923B2

(12) United States Patent
Lax

(10) Patent No.: US 7,592,923 B2
(45) Date of Patent: Sep. 22, 2009

(54) SMOKE DETECTION AND LASER ESCAPE INDICATION SYSTEM UTILIZING A CONTROL MASTER WITH BASE AND SATELLITE STATIONS

(75) Inventor: Samuel Lax, Mission Hills, CA (US)

(73) Assignee: L.I.F.E. Support Technologies, LLC, Mission Hills, CA (US)

( * ) Notice: Subject to any disclaimer, the term of this patent is extended or adjusted under 35 U.S.C. 154(b) by 0 days.

(21) Appl. No.: 12/187,500

(22) Filed: Aug. 7, 2008

(65) Prior Publication Data

US 2008/0291037 A1 Nov. 27, 2008

Related U.S. Application Data

(63) Continuation-in-part of application No. 11/422,666, filed on Jun. 7, 2006.

(51) Int. Cl.
*G08B 17/10* (2006.01)

(52) U.S. Cl. ..... 340/628; 340/632; 340/500; 340/532

(58) Field of Classification Search ..... 340/627–634, 340/500, 528, 532
See application file for complete search history.

(56) References Cited

U.S. PATENT DOCUMENTS

| | | | | |
|---|---|---|---|---|
| 4,148,023 | A | 4/1979 | Elkin | |
| 4,166,960 | A | 9/1979 | Meili | |
| 4,199,754 | A | 4/1980 | Johnson et al. | |
| 4,570,155 | A | 2/1986 | Skarman et al. | |
| 4,649,376 | A | 3/1987 | Frank | |
| 4,763,115 | A | 8/1988 | Cota | |
| 4,801,928 | A | 1/1989 | Minter | |
| 4,808,977 | A | 2/1989 | Hedrick | |
| 4,827,244 | A | 5/1989 | Bellavia et al. | |
| 5,140,301 | A | 8/1992 | Watanabe | |
| 5,572,183 | A | 11/1996 | Sweeney | |
| 5,612,665 | A | 3/1997 | Gerhardsen | |
| 5,889,468 | A * | 3/1999 | Banga | 340/628 |
| 6,078,269 | A * | 6/2000 | Markwell et al. | 340/517 |
| 6,150,943 | A | 11/2000 | Lehman et al. | |
| 6,181,251 | B1 * | 1/2001 | Kelly | 340/628 |
| 6,323,780 | B1 * | 11/2001 | Morris | 340/692 |
| 6,420,973 | B2 * | 7/2002 | Acevedo | 340/628 |
| 7,005,994 | B2 * | 2/2006 | King | 340/628 |
| 7,019,646 | B1 * | 3/2006 | Woodard et al. | 340/539.26 |
| 7,148,810 | B2 * | 12/2006 | Bhat | 340/692 |
| 7,199,724 | B2 * | 4/2007 | Danvir et al. | 340/691.1 |
| 7,259,656 | B1 * | 8/2007 | Wright | 340/286.14 |
| 7,423,543 | B2 * | 9/2008 | Cartwright et al. | 340/628 |
| 2001/0038336 | A1 * | 11/2001 | Acevedo | 340/628 |
| 2002/0149491 | A1 * | 10/2002 | Crandall et al. | 340/691.1 |
| 2004/0021576 | A1 * | 2/2004 | Scott et al. | 340/628 |
| 2006/0132299 | A1 * | 6/2006 | Mansfield et al. | 340/538 |

(Continued)

*Primary Examiner*—Eric M Blount
(74) *Attorney, Agent, or Firm*—Kelly Lowey & Kelley, LLP

(57) ABSTRACT

A smoke detection and escape indication system includes a master controller in communication a base unit and a satellite unit. The base unit and the satellite unit are each in wireless communication with one another and include a wireless receiver, a wireless transmitter, a sensor for detecting a hazard and an escape indication mechanism. The base unit and the satellite unit cooperate to indicate an escape route by coordinating respective escape indication mechanisms in the event that one of the units detect a hazard.

30 Claims, 7 Drawing Sheets

U.S. PATENT DOCUMENTS

2006/0176169 A1* 8/2006 Doolin et al. ..... 340/521
2008/0180229 A1* 7/2008 Piccolo, III et al. ..... 340/332
2008/0258924 A1* 10/2008 Moss ..... 340/577

* cited by examiner

SMOKE DETECTION AND LASER ESCAPE INDICATION SYSTEM UTILIZING A CONTROL MASTER WITH BASE AND SATELLITE STATIONS

BACKGROUND OF THE INVENTION

The present invention relates to a smoke detection and laser escape indication system utilizing a control master with a plurality of base and satellite stations. More particularly, the invention relates to a smoke detection and laser escape indication system having a plurality of base and satellite stations that intercommunicate with one another via radio frequency.

Smoke alarms and detectors in general are well known in the prior art. Two examples of modern smoke alarms are provided in U.S. Pat. No. 4,827,244 to Bellavia et al. and U.S. Pat. No. 4,166,960 to Meili. Typically, smoke detectors simply activate an audible alarm to alert people nearby that there is a fire.

Improved smoke detectors not only sound an alarm when smoke is detected, but also activate powerful lights or flashing strobes to help direct people to an exit. U.S. Pat. No. 4,649,376 to Frank, for example, discloses the use of powerful flashing Xenon lamps to pierce smoke and direct people to the exit. Other examples of this technology are described in U.S. Pat. No. 4,148,023 to Elkin, U.S. Pat. No. 4,570,155 to Skarman et al. and U.S. Pat. No. 4,763,115 to Cota. While these devices can be useful in some circumstances, the flashing incandescent lights can tend to daze or confuse people rather than provide direction. This is especially so in a smoky room where it may not be apparent where the flashes of light are originating. Furthermore, intense flashing lights destroy night vision, often causing more harm than good to confused people trying to escape from a dark building. Additionally, Cota further discloses the use of a redundant circuit activated by a central audio alarm that triggers the smoke alarm and flashing circuits. U.S. Pat. No. 5,572,183 to Sweeney also discloses a device that sweeps a laser beam across a plurality of mirrors. Each mirror directs the laser beam into the floor at a different location, thereby "walking" that apparent laser beam toward an exit. U.S. Pat. No. 5,140,301 to Watanabe further discloses a centrally controlled network that generates a laser which is guided and oscillated by a controlling mirror.

U.S. Pat. No. 6,181,251 to Kelly discloses a combination smoke detection device and laser escape indicator. The combination indicator includes a means for detecting smoke and a laser for directing to or identifying an exit within a room or building. Multiple detection devices may be networked within a building without installing a centrally managed fire alarm system. The second (or multiple) smoke detection device includes a second laser that generates a second laser beam to trigger a laser sensor mounted on any one of a plurality of smoke detection devices. This system requires a line-of-sight between the second laser beam and the laser sensor. When properly mounted to the ceiling, the network of smoke detection devices in Kelly is unable to communicate with other devices outside a room unless the laser beam was able to penetrate walls, bend around corners or penetrate floors or ceilings. In this regard, any obstruction in the way of the laser beam (e.g. resulting from a fire hazard) would prevent the laser sensor from activating a second smoke detection device. This is particularly disadvantageous as the identification of a hazard in one part of a building could not be communicated to a person in another part of the building (e.g. a separate floor).

There exists, therefore, a significant need for a smoke detection and laser escape indication system utilizing a plurality of base and satellite stations capable of intercommunicating with one another via radio frequency. Such an improved smoke detection and laser escape indication system should include at least a base unit and a satellite unit each having a means for detecting a fire hazard and a means for communicating the fire hazard to other detector units within the monitored area, a control master unit remote to the base and satellite units yet capable of communicating with all base and satellite units within the monitored area, should be capable of remotely notifying people of a fire hazard and should be capable of activating all base and satellite units within the monitored area in the event that one or more of the base or satellite units are destroyed. The present invention fulfills these needs and provides further related advantages.

SUMMARY OF THE INVENTION

The smoke detection and escape indication system of the present invention includes a master controller in communication with a base unit and a satellite unit. The base unit and the satellite unit are in wireless communication with one another via a wireless receiver and a wireless transmitter. Preferably, the wireless receiver and the wireless transmitter communicate by radio frequency, Bluetooth or Wi-Fi. The base unit and the satellite unit may also communicate with one another by multiple path communication through the master controller. The base unit and the satellite unit also include a sensor for detecting a hazard and an escape indication mechanism for identifying an exit. Accordingly, the base unit and the satellite unit cooperate to indicate an escape route in the event that either unit detects a hazard. This is done by coordinating respective escape indication mechanisms. Moreover, the master controller may communicate directly with the base unit or the satellite unit in the event that a hazard is detected in another portion of the building.

The master controller further includes a wireless receiver and a wireless transmitter capable of communicating with the base unit or the satellite unit by radio frequency, Bluetooth or Wi-Fi. In a preferred embodiment, the master controller is also hard wired to the base unit and the satellite unit. This ensures that the master controller is able to, at all times, communicate with both the base unit and the satellite unit. Accordingly, the master controller may activate the base unit or the satellite unit in response to a hazard detected by the opposite unit. The master controller may also regulate the maintenance of the base unit or the satellite unit. In a similar sense, a graphical user interface is coupled to the master controller for displaying the base unit and the satellite unit within a structure. The graphical user interface may also display a hazard detected by either the base unit or the satellite unit. In this event, the graphical user interface may also provide a path to the detected hazard.

Moreover, the escape indication mechanism of the present invention preferably comprises a laser canon, a speaker, a strobe light or a wireless camera. Accordingly, the laser canon provides a lighted path, the speaker issues an audible alarm preferably comprising a prerecorded message, the strobe light illuminates an exit, and the wireless camera records pictures or video in response to the base unit or the satellite unit activating after detecting a hazard. The base unit and the satellite unit have sensors that preferably comprise a photoelectric detector, an ionization detector or a carbon monoxide detector. The base unit and the satellite unit may include the same sensors and escape indication mechanisms or may comprise different sensors and different escape indication mechanisms. The smoke detection and escape indication system of the present invention may also include multiple base units and multiple satellite units distributed throughout a structure. Each of the base units and the satellite units are capable of communicating with each other and the master controller.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE PREFERRED EMBODIMENTS

Figure 1:
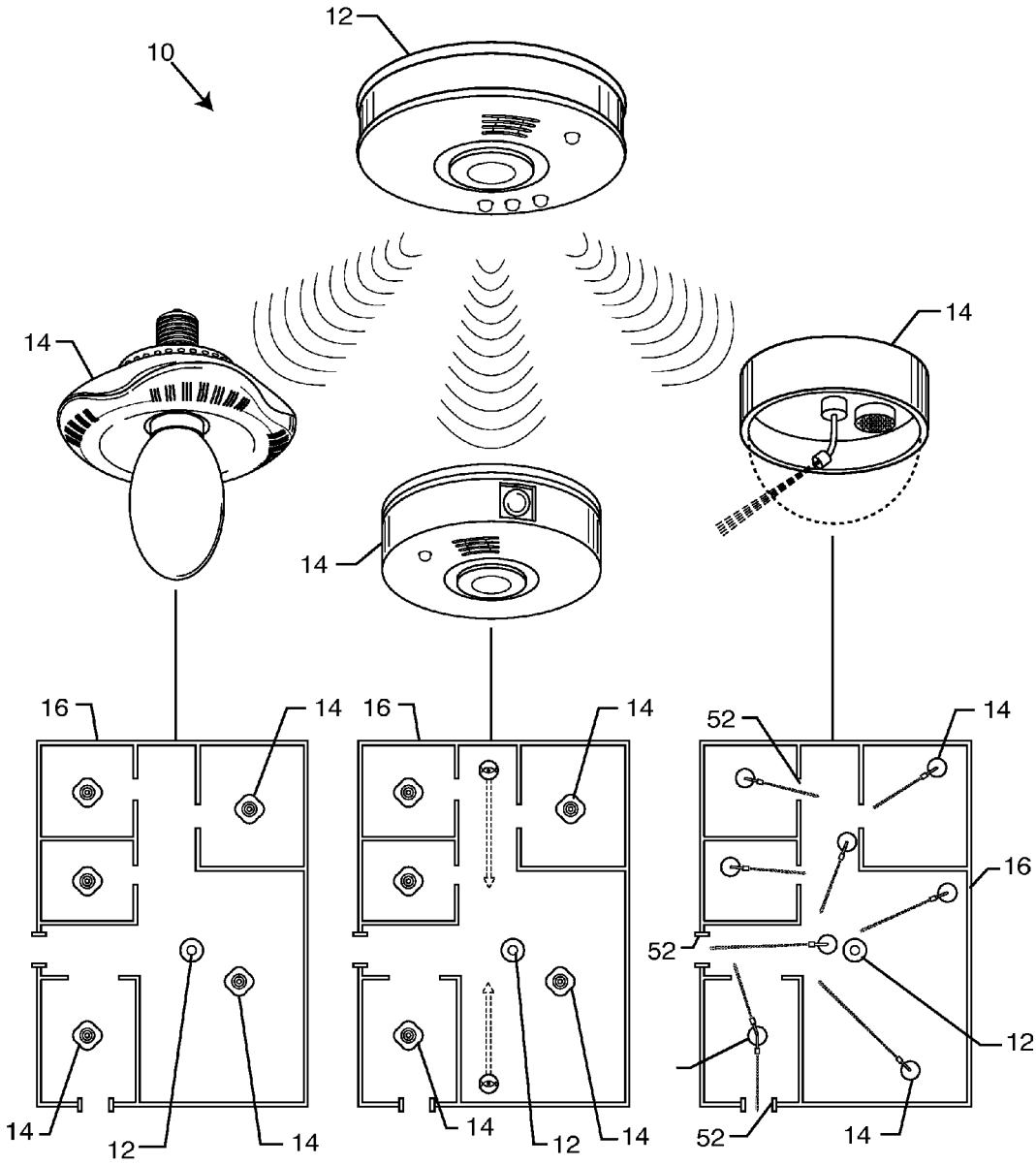
FIG. 1 is a schematic diagram illustrating a base unit in communication with multiple satellite units in accordance with the present invention.

As shown in the drawings for purposes of illustration, the present invention for a smoke detection and laser escape indication system is referred to generally by the reference number 10. In one embodiment of the present invention, FIG. 1 illustrates the smoke detection and laser escape indication system 10 comprising a base unit 12 in communication with one or more satellite units 14. The base unit 12 preferably communicates with the satellite units 14 by "Bluetooth" wireless communication, radio frequency (RF) transmission or other compatible types of wireless communications between modern electronic devices, such as infrared or WiFi. The smoke detection and laser escape indication system 10 provides audible and visual notification and exit-path guidance in and around a fire-related hazard. One or more base units 12 are utilized with one or more satellite units 14 in a grid or array of multiple intelligent smoke detectors in accordance with the present invention. As described below, the base units 12 and the satellite units 14 are capable of interacting with one another and provide the ability to by-pass one or several of the base units 12 or satellite units 14 that may have failed due to a catastrophic event during a fire hazard. FIG. 1 is a sample embodiment of the base unit 12 and a plurality of satellite units 14 disposed intermittently within a floor 16. As shown, the smoke detection and laser escape indication system 10 is installed in several floors 16 such that one or more of the base units 12 are distributed throughout the floors 16 to provide adequate hazard detection coverage to ensure safety of those inside the structure.

Figure 2:
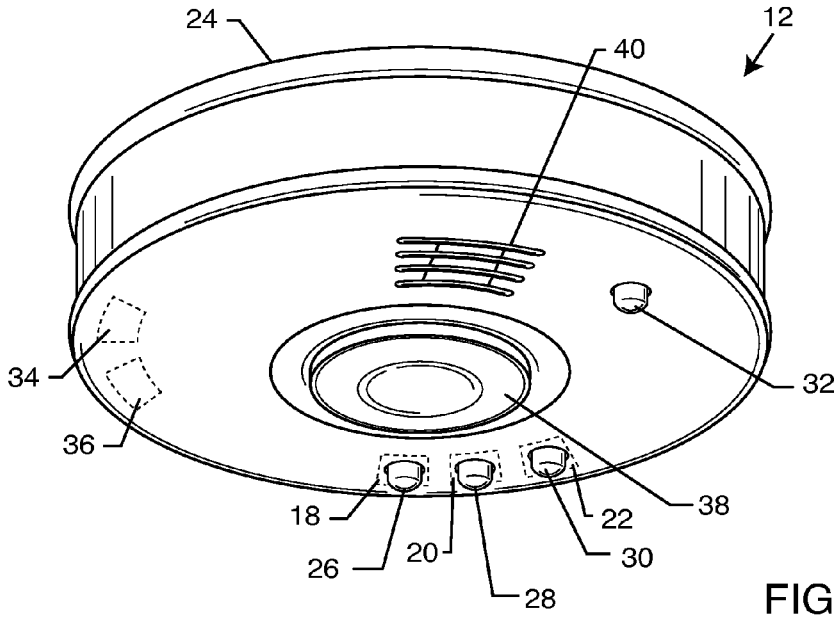
FIG. 2 is a perspective view of a base unit of the present invention.

FIG. 2 illustrates the base unit 12 having an ionization smoke detector circuit 18, a photoelectric smoke detector circuit 20 and a carbon monoxide detector circuit 22. Each of the circuits 18, 20, 22 are located internal to an outer casing 24 of the base unit 12. Accordingly, the base unit 12 includes an ionization smoke detector LED 26, a photoelectric smoke detector LED 28 and a carbon monoxide detector LED 30 coupled to the respective circuits 18, 20, 22 to externally display the current operating conditions of those circuits 18, 20, 22. In one embodiment of the present invention, the LEDs 26, 28, 30 remain unlit when the respective circuits 18, 20, 22 are functioning properly. Alternatively, one or more of the LEDs 26, 28, 30 may blink or fully light in the event of a malfunction or when detecting a corresponding hazard. The purpose of the LEDs 26, 28, 30 is to provide external visual notification of the operating condition of the corresponding circuits 18, 20, 22. Additionally, the base unit 12 may include a power indicator LED 32 also protruding from the outer casing 24. The power indicator LED 32 provides external notification of a properly powered and operating base unit 12. Preferably, the power indicator LED 32 blinks at intervals of thirty seconds to provide notification that the base unit 12 is powered and functioning correctly.

The base unit 12 in FIG. 2 also includes a communication transmitter 34 and a communication receiver 36 configured to facilitate wireless communication via any one of a number of modern electronic wireless standards. In a particularly preferred embodiment, the communication transmitter 34 and the communication receiver 36 utilize either "Bluetooth" wireless communication or radio frequency communication. Bluetooth is an industry standard for limited range wireless (radio) communication between modern electronic devices interfaced to electronic computers and Personal Data Assistants (PDAs). In this embodiment, the communication transmitter 34 could communicate with a remote device having the communication receiver 36. The communication transmitter 34 and the communication receiver 36 are also integrated with the satellite units 14 for communication therebetween, as described in more detail below. The base unit 12 may also include a test button 38 for testing the base unit 12 or the smoke detection and laser escape indication system 10. A vent 40 may provide access to the internal detector circuits 18, 20, 22 or provide an opening for conveying an audible alarm.

Figure 3:
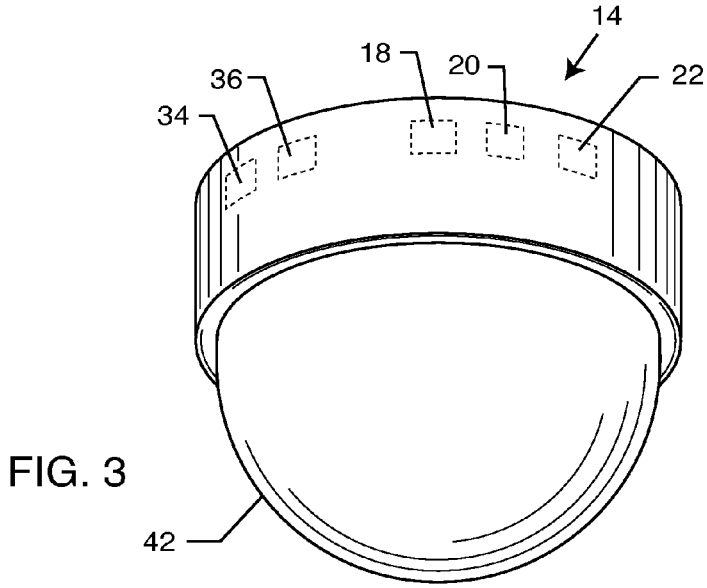
FIG. 3 is a perspective view of a satellite unit of the present invention.

FIGS. 3-8 illustrate several variations of the satellite units 14 in accordance with the present invention. For example, FIG. 3 illustrates the satellite unit 14 including a translucent dome 42. As shown in phantom, the satellite unit 14 includes the ionization smoke detector circuit 18, the photoelectric smoke detector circuit 20 and the carbon monoxide detector circuit 22. Additionally, the satellite unit 14 includes the communication transmitter 34 and the communication receiver 36, also shown in phantom. Incorporation of the detector circuits 18, 20, 22 with the communication transmitter 34 and the communication receiver 36 enables the satellite units 14 to detect a fire hazard and communicate the detection to other base units 12 and satellite units 14 within the smoke detection and laser escape indication system 10. Of course, the satellite unit 14 of FIGS. 3-8 could include any combination of the detector circuits 18, 20, 22, the communication transmitter 34 and the communication receiver 36.

Figure 4:
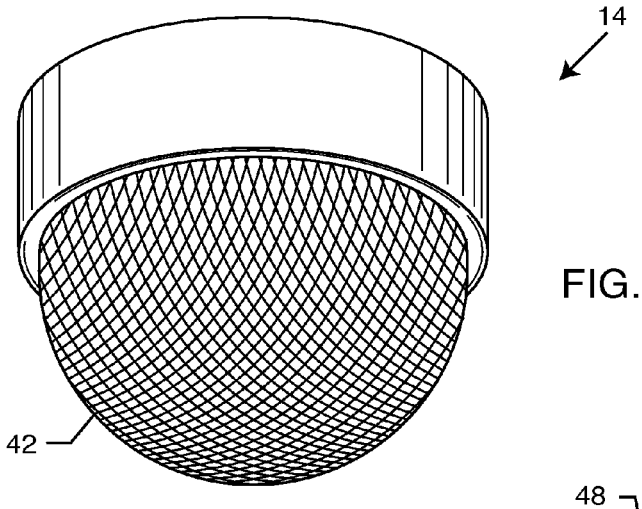
FIG. 4 is a perspective view of an alternate satellite unit of the present invention.
Figure 5:
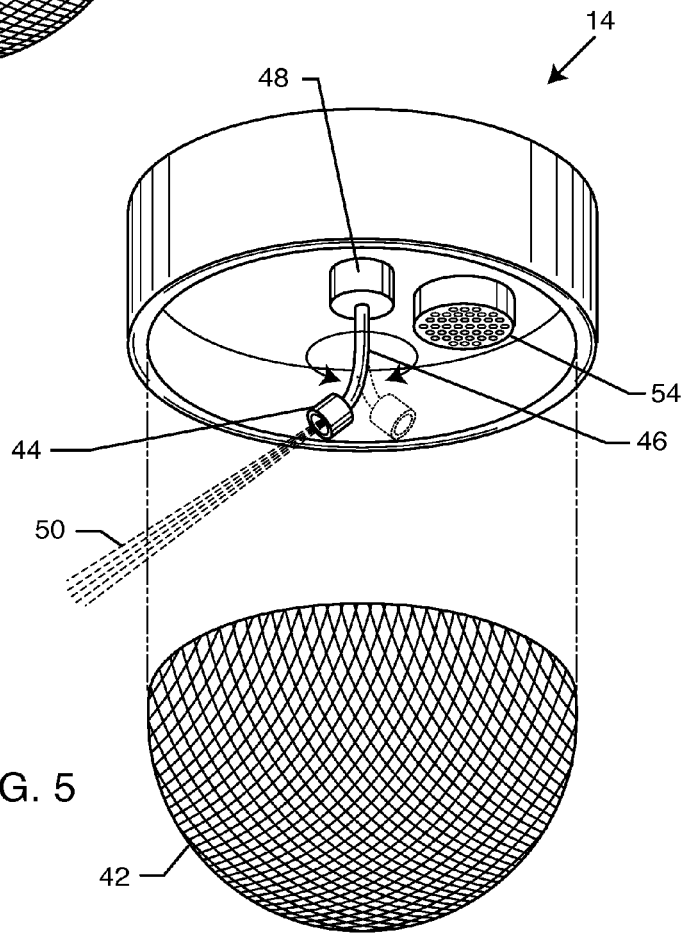
FIG. 5 is an exploded perspective view of the alternate satellite unit of FIG. 4.

FIG. 4 illustrates an alternative satellite unit 14 having a translucent dome 42 that encompasses a laser canon 44. The laser canon 44 is shown in FIG. 5 mounted to a flexible arm 46 coupled to a rotatable base 48. The flexible arm 46 and the rotatable base 48 enable a user to strategically position the laser canon 44 to project a laser beam 50 out from the translucent dome 42. In this embodiment, the user may strategically position the laser canon 44 to illuminate an exit 52 (FIG. 1) or a path to the exit 52. FIG. 5 further illustrates the satellite unit 14 having a speaker 54 capable of providing audible notification of a hazard detected by any one of the detector circuits 18, 20, 22.

Figure 6:
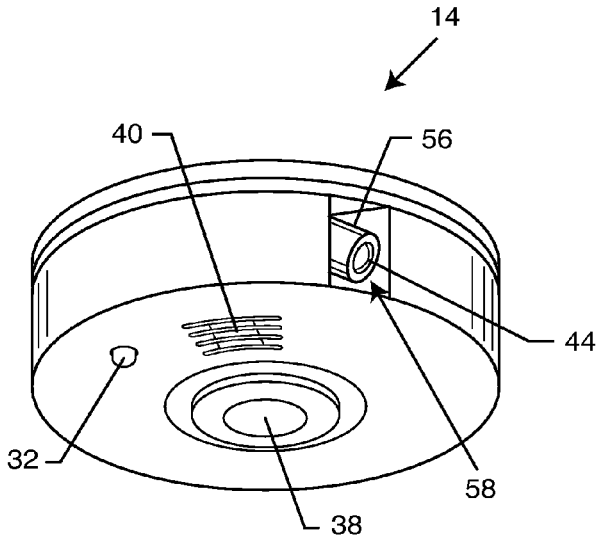
FIG. 6 is a perspective view of another alternate satellite unit of the present invention, including a laser cannon.

FIG. 6 illustrates an alternative version of the satellite unit 14 including the laser canon 44 coupled to an adjustable hinge 56. The hinge 56 rotates the laser canon 44 within a chamber 58. The hinge 56 is less versatile than the laser canon 44 mounted to the flexible arm 46 and the rotatable base 48 of FIG. 5, but is more robust in its positioning. The satellite unit 14 illustrated in FIG. 6 further includes the test button 38, the vent 40 and the power indicator LED 32.

Figure 7:
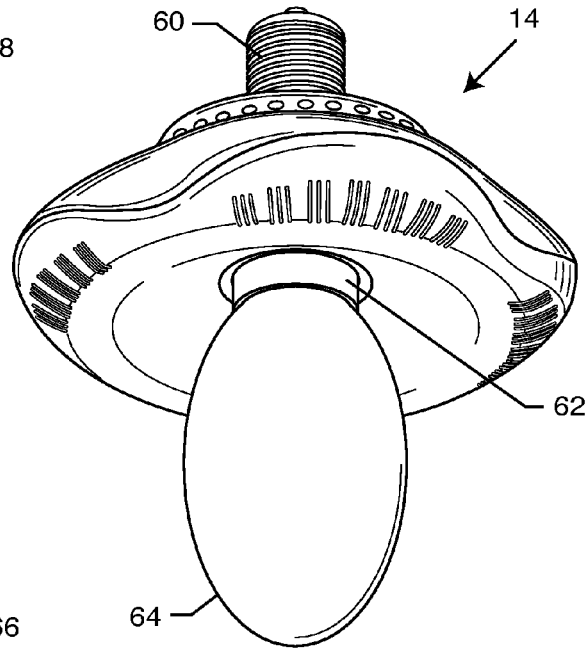
FIG. 7 is a perspective view of another alternate satellite unit of the present invention, including a strobe light.

FIG. 7 illustrates another alternative embodiment of the satellite unit 14 in accordance with the present invention. Here, the satellite unit 14 includes a fixture 60 capable of screwing into a standard light bulb adapter. Accordingly, the satellite unit 14 further includes an adapter 62 capable of receiving a light bulb 64. In fact, the satellite unit 14 illustrated in FIG. 7 is substantially similar to and incorporates the embodiments disclosed in U.S. Publication No. 2007/0285262, the contents of which are herein incorporated by reference. Accordingly, the satellite unit 14 preferably includes each of the detector circuits 18, 20, 22, the communication transmitter 34 and the communication receiver 36. The light bulb 64 may be configured to strobe, flash or illuminate a room or path to an exit.

Figure 8:
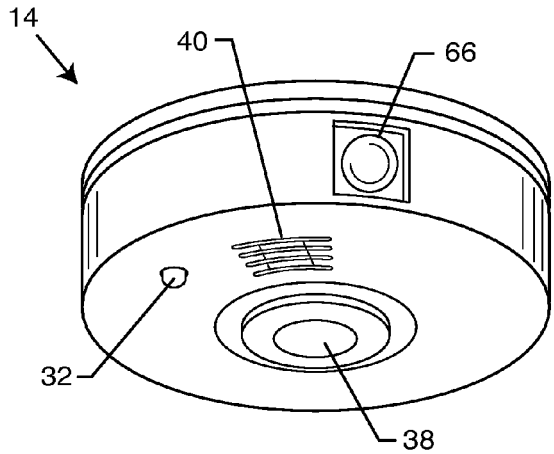
FIG. 8 is a perspective view of another alternate satellite unit of the present invention, including a video camera.

Similarly, in FIG. 8 the satellite unit 14 includes a wireless camera 66 in addition to the power indicator LED 32, the test button 38 and the vent 40. The wireless camera 66 may be capable of transmitting a signal to a computer or another internet ready device. The wireless camera 66 would be equipped to scan and take pictures of the area immediate to the satellite unit 14 in the event that the satellite unit 14 detects a hazard. Alternatively, the wireless camera 66 may capture an image or record video in response to another one of the base units 12 or satellite units 14 activating due to detection of a hazard.

The multiple base units 12 and multiple satellite units 14 may be distributed throughout the floors 16 as shown in FIG. 1. In particular, the satellite units 14 that include the laser canon 44 are distributed throughout the floor 16 such that the laser canon 44 illuminates at least one available exit 52. Similarly, the satellite units 14 that include the light bulb 64 may also be distributed throughout the floor 16 such that the light bulb 64 illuminates a pathway out of the room or structure. In another embodiment of the present invention, the satellite units 14 having the wireless camera 66 may be distributed throughout the floor 16 such that the wireless camera 66 records and transmits an image of one or more pathways out of the room or structure. In particular, the image may be viewed remotely for the safety of persons within the structure. Moreover, the satellite units 14 may also include the speaker 54 for use with any of the aforementioned detector circuits 18, 20, 22, the communication transmitter 34, the communication receiver 36, the laser canon 44, the light bulb 64 or the wireless camera 66. The speaker 54 may also be used alone to provide audible notification of a hazard. The satellite units 14 including only the speaker 54 should be distributed throughout the floor 16 to ensure the audible warning issued from the speaker 54 can be heard throughout the floor 16 or multiple floors 16. This ensures adequate warning of a fire hazard to those located in remote locations on another level of the structure.

The base units 12 and the satellite units 14 may each be equipped with any one or a combination of the detector circuits 18, 20, 22, the communication transmitter 34, the communication receiver 36, the laser canon 44, the speaker 54, the light bulb 64 or the wireless camera 66. In a particularly preferred embodiment, each base unit 12 and each satellite unit 14 for use with the smoke detection and laser escape indication system 10 of the present invention includes at least one of the detector circuits 18, 20, 22 and both the communication transmitter 34 and the communication receiver 36. This ensures that each base unit 12 and each satellite unit 14 is capable of detecting one form of hazard via the detector circuits 18, 20, 22 and is capable of transmitting and receiving hazard information in and among each base unit 12 and each satellite unit 14 via the communication transmitter 34 and the communication receiver 36.

Figure 9:
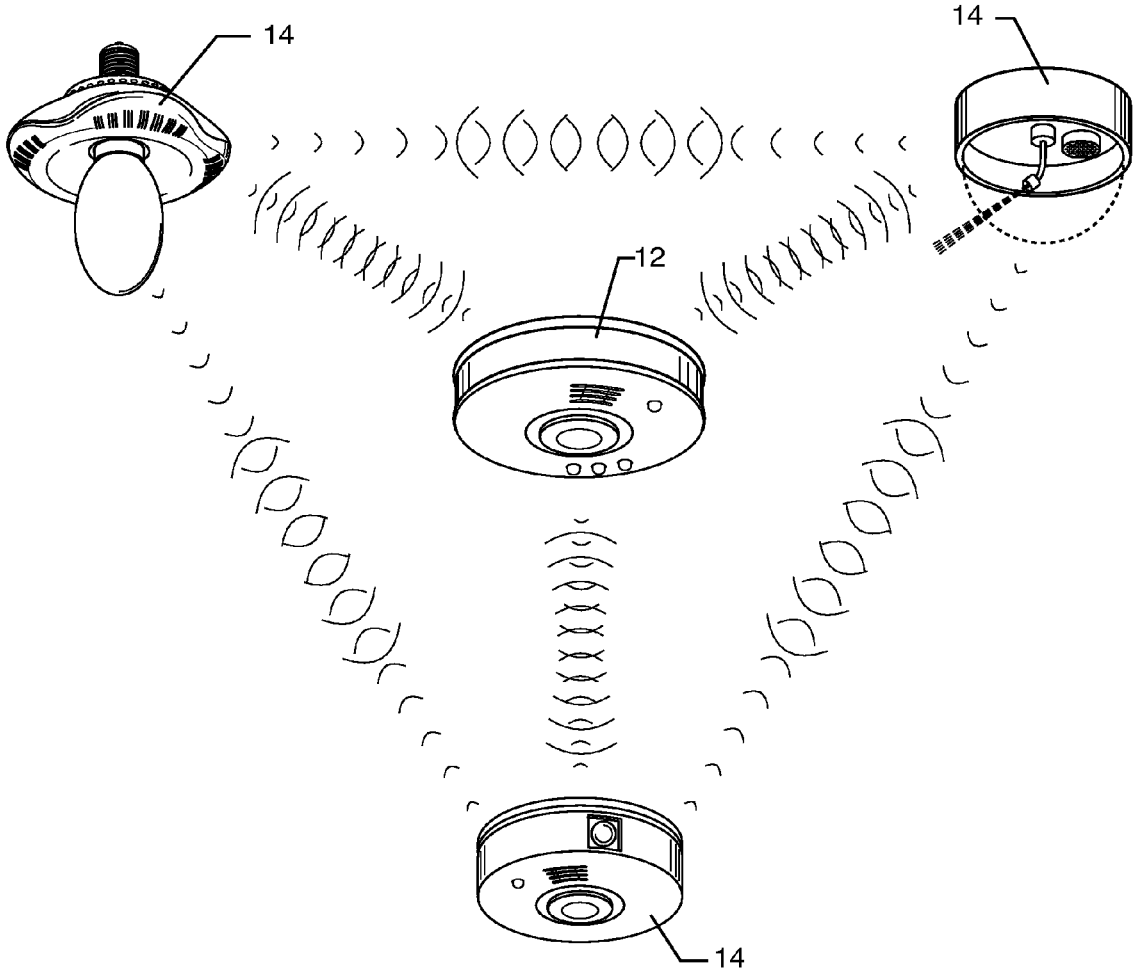
FIG. 9 is a schematic diagram illustrating intercommunication of a base unit and a plurality of satellite units.

A preferred embodiment of the present invention is generally shown in FIG. 9 wherein the base unit 12 and the satellite units 14 are capable of communicating among one another via the previously described communication transmitter 34 and the communication receiver 36. Accordingly, the communication receiver 36 is configured to receive and process the signal broadcast by the communication transmitter 34. When the communication receiver 36 receives the broadcast signal from the communication transmitter 34, the corresponding base unit 12 or satellite unit 14 receiving the communication effectively activates an alarm or other notification described herein. Moreover, the receiving base unit 12 or satellite unit 14 is capable of retransmitting the broadcast via the communication transmitter 34 to another base unit 12 or satellite unit 14 having a similar communication receiver 36. In practice, the intercommunication among the base units 12 and the satellite units 14 result in a greater level of safety for persons within a structure. The use of the communication transmitter 34 and the communication receiver 36 in each base unit 12 and each satellite unit 14 permits the simultaneous activation of every base unit 12 and satellite unit 14 within an overlapping monitored range. Hence, this ensures that all persons within a structure are alerted to a hazard at the same time. Accordingly, persons on the opposite side of the structure from a detected hazard may receive warning before the hazard actually reaches the area where the person is located.

Figure 10:
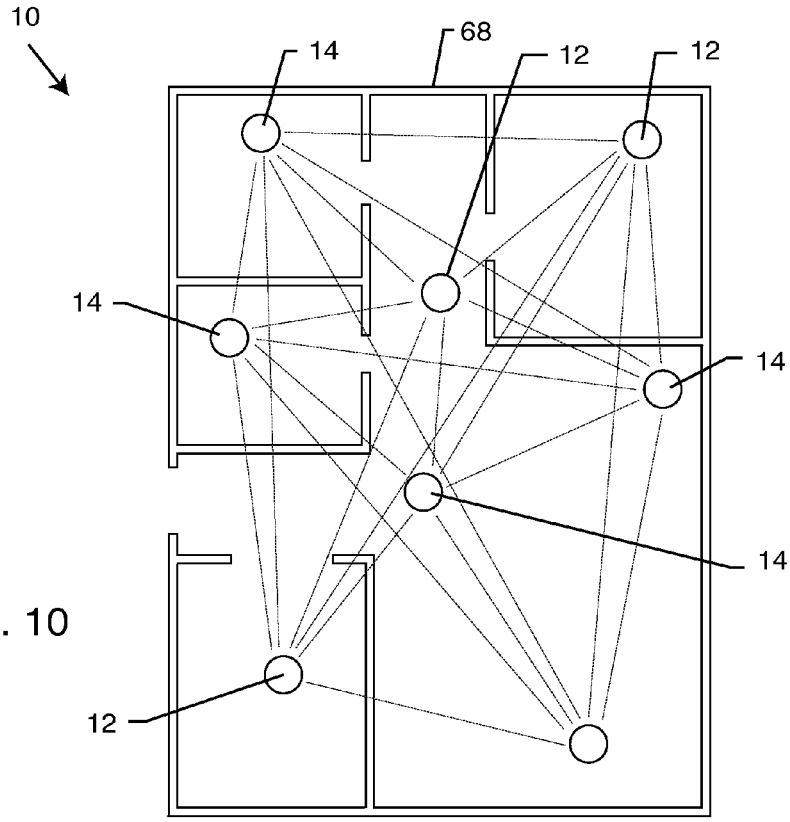
FIG. 10 is a schematic view illustrating intercommunication of multiple base and satellite units within multiple rooms of a structure.
Figure 11:
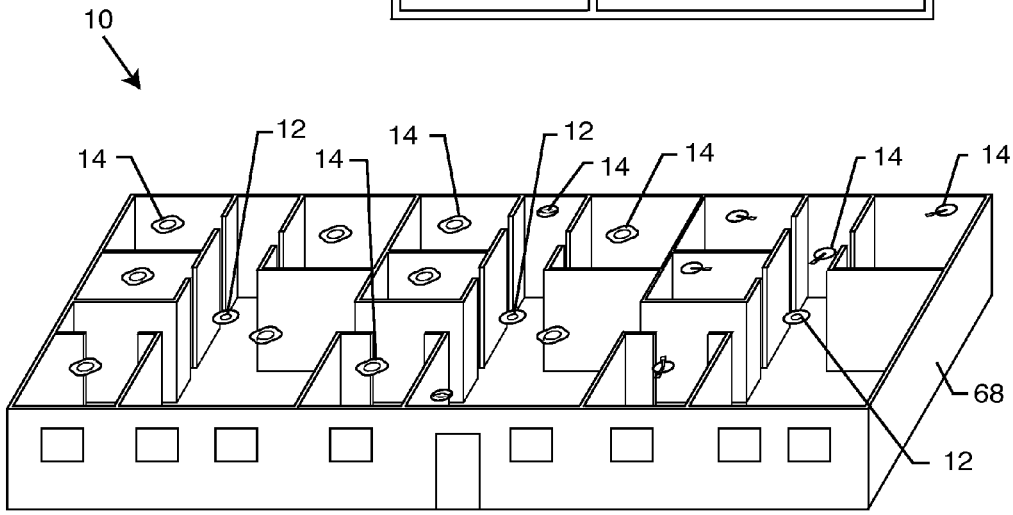
FIG. 11 is a perspective view of the base and satellite units disposed within the structure.

FIGS. 10 and 11 illustrate the intercommunication among the base units 12 and the satellite units 14 in accordance with the present invention. When one of the base units 12 or the satellite units 14 detect the presence of a hazard by one of the detector circuits 18, 20, 22, e.g. smoke or carbon monoxide, the radio frequency transmitter 34 broadcasts a signal to activate all base units 12 and satellite units 14 within the monitored range of the activated unit. The activated units in turn further activate other units outside the range of the original unit detecting the hazard. This process occurs henceforth until adequate notification is provided within the entire structure 68. In this way, the smoke detection and laser escape indication system 10 may detect a hazard and provide an escape route with a minimum quantity of base units 12 and satellite units 14 installed in the structure 68. Alternatively, each base unit 12 and each satellite unit 14 may be equipped with a specific detector circuit 18, 20, 22 depending on the particular hazard that may be specific to the installation location. Likewise, each base unit 12 and each satellite unit 14 may be equipped with the laser canon 44, the speaker 54, the light bulb 64 and the wireless camera 66 as needed for the specific installation location. Again, each of the base units 12 and the satellite units 14 preferably include at least one of the detector circuits 18, 20, 22 and a mechanism for intercommunicating wirelessly. Hence, each of the base units 12 and the satellite units 14 are capable of detecting a hazard and broadcasting the detected hazard to any one of a plurality of the base units 12 and the satellite units 14 within range.

The components of the smoke detection and laser escape indication system 10 have increased moisture and corrosion resistance with the application of a spray-on silicon. Spray-on silicon protects the circuits and other electronic components of the base units 12 and the satellite units 14 from corrosion or degradation due to moisture in the air. This improved corrosion resistance increases the effective lifespan of the base units 12 and the satellite units 14.

Figure 12:
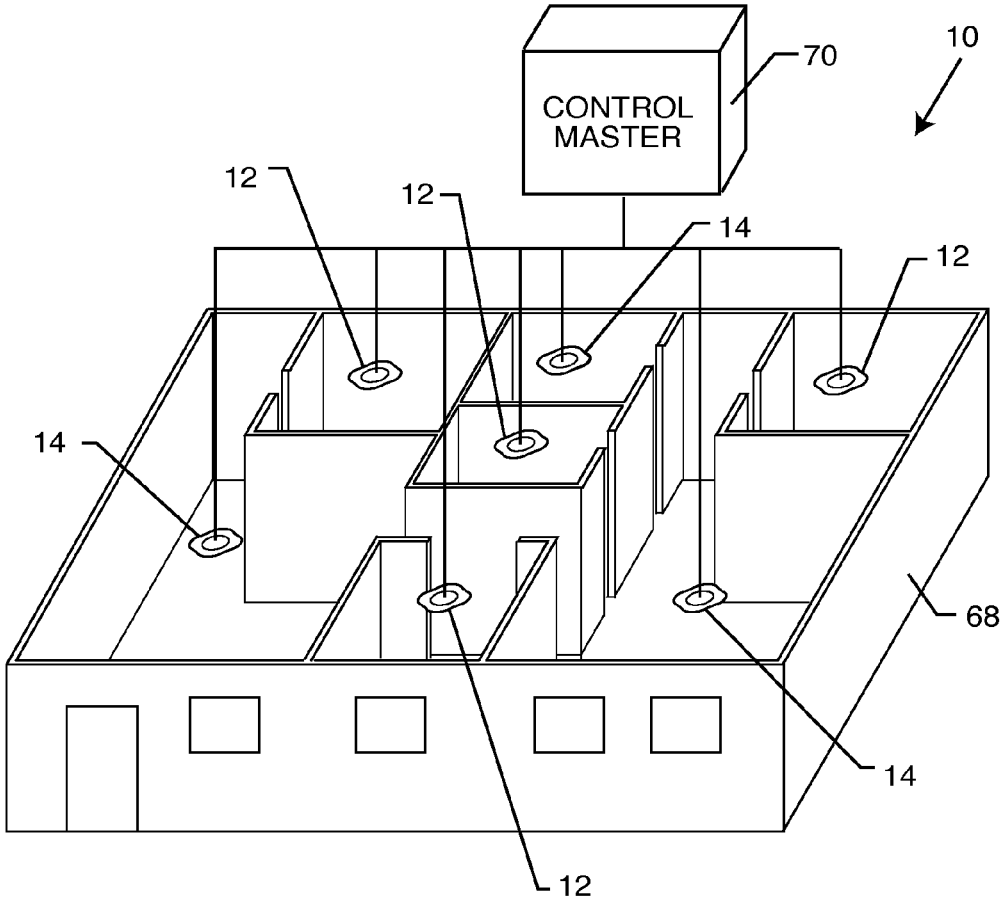
FIG. 12 is a perspective schematic view illustrating communication of the base and satellite units with a control master.

FIG. 12 illustrates another alternative embodiment of the smoke detection and laser escape indication system 10 of the present invention. FIG. 12 illustrates a grid or array of the base units 12 and the satellite units 14 disposed within the structure 68. This embodiment provides two basic levels of protection in accordance with the present invention. First, the base units 12 and the satellite units 14 disposed within the structure 68 are capable of intercommunicating with one another via individual communication transmitters 34 and individual communication receivers 36, as described above. Second, each of the base units 12 and the satellite units 14 are interconnected, either hard wired or wirelessly, with a control master 70 that governs the operation of all the base units 12 and the satellite units 14 that comprise the smoke detection and laser escape indication system 10.

The control master 70 is preferably a dedicated computer or other remote regulatory device that governs the operation of the base units 12 and the satellite units 14 and is therefore considered part of the "Master Level". The control master 70 communicates with each base unit 12 and each satellite unit 14 within the structure 68. The control master 70 is capable of establishing the status of each of the units 12, 14. The path of communication between the control master 70 and the units 12, 14 is by multiple path communication, which provides alternative path selection if one or more of the units 12, 14 become inoperative. In this case, the control master 70 is capable of monitoring the status of each base unit 12 and each satellite unit 14 through the communication of the base units 12 and the satellite units 14 via the communication transmitters 34 and the communication receivers 36, as described above. Hence, the control master 70 does not need a direct connection to ascertain the status of the base unit 12 or the satellite unit 14. Henceforth, all communication among the base units 12, the satellite units 14 and the control master 70 are relayed from one device to another to allow virtually unlimited monitoring. The base units 12 and the satellite units 14 are accordingly considered part of the "Subordinate Level". As the name indicates, the units 12, 14 are subordinate to the Master Level comprising the control master 70. The base units 12 and the satellite units 14 can initiate communication with the control master 70 to announce the detection of a hazard, as described above.

In a particularly preferred embodiment, the base units 12 and the satellite units 14 are also capable of notifying the control master 70 of needed maintenance. In this case, the smoke detection and laser escape indication system 10 of the present invention can be monitored remotely and each of the base units 12 and the satellite units 14 do not need to be inspected individually to provide proper maintenance. The base units 12 and the satellite units 14 may be equipped with software to automatically notify the control master 70 in the event that one of the detector circuits 18, 20, 22, the laser canon 44, the speaker 54, the light bulb 64 or the wireless camera 66 malfunction. Operation of the control master 70 is preferably used with a popular computer operating system such as Microsoft Windows NT, XP, Windows 2000, Windows 98 SE, Windows Vista or Windows Mobile. A graphical user interface (GUI) may display a map of the structure 68 showing where each of the base units 12 and the satellite units 14 are located therein. Furthermore, the GUI shows real-time status of each of the units 12, 14. In this regard, the smoke detection and laser escape indication system 10 can provide the necessary information to an emergency response team to immediately and quickly identify the location of a hazard. Enhanced response time translates to less damage and a higher likelihood that the hazard will be subdued before the structure 68 incurs more damage or causes harm to people within the structure 68. In this embodiment, the GUI could also provide a direct route within the structure 68 to an emergency response team endeavoring to subdue the detected hazard.

Although several embodiments of the present invention have been described in detail for purposes of illustration, various modifications may be made to each without departing from the spirit and scope of the invention. Accordingly, the invention is not to be limited, except as by the appended claims.

What is claimed is:

1. A smoke detection and escape indication system, comprising:

a master controller;

a base unit in communication with the master controller; and a satellite unit in communication with the master controller and in wireless communication with the base unit, the base unit and the satellite unit each include a wireless receiver, a wireless transmitter, a sensor and an escape indication mechanism;

wherein the base unit and the satellite unit cooperate to indicate an escape route in the event of a detected hazard.

2. The system of claim 1, wherein the wireless receiver and the wireless transmitter communicate by radio frequency, Bluetooth or Wi-Fi.

3. The system of claim 1, wherein the master controller is hardwired to the base unit or the satellite unit.

4. The system of claim 1, wherein the master controller includes a wireless receiver and a wireless transmitter that communicates with the base unit or the satellite unit by radio frequency, Bluetooth or Wi-Fi.

5. The system of claim 1, wherein the master controller activates the base unit or the satellite unit in response to a hazard detected by the opposite unit.

6. The system of claim 1, wherein the base unit and the satellite unit communicate by multiple path communication through the master controller.

7. The system of claim 1, wherein the master controller regulates the maintenance of the base unit or the satellite unit.

8. The system of claim 1, including a graphical user interface coupled to the master controller for displaying the base unit, the satellite unit, or the detected hazard.

9. The system of claim 8, wherein the graphical user interface displays a path to the detected hazard.

10. The system of claim 1, wherein the base unit and the satellite unit cooperate to identify an exit by coordinating respective escape indication mechanisms.

11. The system of claim 1, wherein the escape indication mechanism comprises a laser cannon, a speaker, a strobe light or a wireless camera.

12. The system of claim 11, wherein the laser cannon provides a lighted path, the speaker issues an audible alarm, the strobe light illuminates an exit, or the wireless camera records pictures or video.

13. The system of claim 12, wherein the audible alarm comprises a prerecorded message.

14. The system of claim 1, including multiple base units and multiple satellite units distributed throughout a structure.

15. The system of claim 1, wherein the sensor comprises a photoelectric detector, an ionization detector or a carbon monoxide detector.

16. The system of claim 1, wherein the base unit and the satellite unit include different sensors or different escape indication mechanisms.

17. A smoke detection and escape indication system, comprising:

a master controller;

a base unit in communication with the master controller; and a satellite unit in communication with the master controller and in wireless communication with the base unit, the base unit and the satellite unit each include a wireless receiver, a wireless transmitter, a sensor and an escape indication mechanism;

wherein the base unit and the satellite unit communicate by multiple path communication through the master controller and cooperate to indicate an escape route by coordinating respective escape indication mechanisms in the event of a detected hazard.

18. The system of claim 17, wherein the wireless receiver and the wireless transmitter communicate by radio frequency, Bluetooth or Wi-Fi.

19. The system of claim 17, wherein the master controller is hardwired to the base unit or the satellite unit and includes a wireless receiver and a wireless transmitter that communicates with the base unit or the satellite unit by radio frequency, Bluetooth or Wi-Fi.

20. The system of claim 17, wherein the master controller activates the base unit or the satellite unit in response to a hazard detected by the opposite unit.

21. The system of claim 17, including a graphical user interface coupled to the master controller for displaying the base unit, the satellite unit, or the detected hazard, wherein the master controller regulates the maintenance of the base unit or the satellite unit.

22. The system of claim 21, wherein the graphical user interface displays a path to the detected hazard.

23. The system of claim 17, wherein the escape indication mechanism comprises a laser cannon that provides a lighted path, a speaker that issues an audible alarm comprising a prerecorded message, a strobe light that illuminates an exit or a wireless camera that records pictures or video.

24. The system of claim 17, including multiple base units and multiple satellite units distributed throughout a structure.

25. The system of claim 17, wherein the sensor comprises a photoelectric detector, an ionization detector or a carbon monoxide detector and wherein the base unit and the satellite unit include different sensors or different escape indication mechanisms.

26. A smoke detection and escape indication system, comprising:

a master controller;

a base unit in communication with the master controller;

a satellite unit in communication with the master controller and in wireless communication with the base unit by radio frequency, Bluetooth or Wi-Fi, the base unit and the satellite unit each include a wireless receiver, a wireless transmitter, a sensor and an escape indication mechanism;

wherein the base unit and the satellite unit communicate by multiple path communication through the master controller and cooperate to indicate an escape route in the event of a detected hazard by coordinating respective escape indication mechanisms; and a graphical user interface coupled to the master controller for displaying the base unit, the satellite unit, or the detected hazard, wherein the master controller activates the base unit or the satellite unit in response to a hazard detected by the opposite unit.

27. The system of claim 26, wherein the master controller is hardwired to the base unit or the satellite unit and includes a wireless receiver and a wireless transmitter that communicates with the base unit or the satellite unit by radio frequency, Bluetooth or Wi-Fi, the master controller regulates the maintenance of the base unit or the satellite unit.

28. The system of claim 26, wherein the graphical user interface displays a path to the detected hazard.

29. The system of claim 26, wherein the escape indication mechanism comprises a laser cannon that provides a lighted path, a speaker that issues an audible alarm comprising a prerecorded message, a strobe light that illuminates an exit or a wireless camera that records pictures or video when the base unit or the satellite unit activate in response to the detected hazard, and wherein the sensor comprises a photoelectric detector, an ionization detector or a carbon monoxide detector.

30. The system of claim 26, including multiple base units and multiple satellite units distributed throughout a structure, wherein the base unit and the satellite unit include different sensors or different escape indication mechanisms.

* * * * *